US009550587B2

(12) United States Patent
Lazarus et al.

(10) Patent No.: US 9,550,587 B2
(45) Date of Patent: Jan. 24, 2017

(54) PACKAGING OF POLYCRYSTALLINE SILICON

(71) Applicant: Wacker Chemie AG, Munich (DE)

(72) Inventors: Werner Lazarus, Mitterskirchen (DE); Christian Fraunhofer, Mitterskirchen (DE); Herbert Schmoelz, Mehring (DE); Matthias Vietz, Mattighofen (AT)

(73) Assignee: Wacker Chemie AG, Munich (DE)

( * ) Notice: Subject to any disclaimer, the term of this patent is extended or adjusted under 35 U.S.C. 154(b) by 309 days.

(21) Appl. No.: 14/068,201

(22) Filed: Oct. 31, 2013

(65) Prior Publication Data

US 2014/0130455 A1 May 15, 2014

(30) Foreign Application Priority Data

Nov. 9, 2012 (DE) ..... 10 2012 220 422

(51) Int. Cl.

| | |
|---|---|
| ***B65B 1/30*** | (2006.01) |
| ***B65B 1/06*** | (2006.01) |
| ***B65B 1/32*** | (2006.01) |
| ***B65B 5/10*** | (2006.01) |
| ***B65B 43/59*** | (2006.01) |
| *B65B 29/00* | (2006.01) |

(52) U.S. Cl.

CPC . *B65B 1/30* (2013.01); *B65B 1/06* (2013.01); *B65B 1/32* (2013.01); *B65B 5/101* (2013.01); *B65B 43/59* (2013.01); *B65B 29/00* (2013.01)

(58) Field of Classification Search

CPC ..... B65B 1/06; B65B 1/30; B65B 1/32; B65B 29/00; B65B 43/59; B65B 5/101

USPC ..... 141/1, 10, 69, 83; 241/13, 19, 24.1, 241/24.18, 9

See application file for complete search history.

(56) References Cited

U.S. PATENT DOCUMENTS

| | | | | |
|---|---|---|---|---|
| 4,185,669 | A * | 1/1980 | Jevakohoff | B65B 39/04 141/263 |
| 4,325,418 | A * | 4/1982 | Henle | B65B 39/12 141/103 |
| 4,791,776 | A * | 12/1988 | Jackman | B65B 1/06 141/10 |
| 4,813,205 | A * | 3/1989 | Mikata | B65B 1/36 209/657 |
| 5,971,038 | A * | 10/1999 | Fiedler | G01G 17/00 141/173 |
| 6,089,285 | A * | 7/2000 | DeStefano | B66F 9/06 141/1 |
| 7,013,620 | B2 | 3/2006 | Hoelzlwimmer et al. | |
| 7,877,966 | B2 * | 2/2011 | Knoke | B65B 1/36 53/451 |
| 8,021,483 | B2 * | 9/2011 | Arvidson | C30B 15/02 117/13 |
| 8,074,905 | B2 * | 12/2011 | Schaefer | B02C 21/00 241/1 |
| 2003/0159647 | A1 * | 8/2003 | Arvidson | C30B 15/02 117/30 |
| 2005/0034430 | A1 * | 2/2005 | Holzlwimmer | B65B 1/32 53/469 |
| 2010/0001106 | A1 * | 1/2010 | Schaefer | B02C 21/00 241/25 |
| 2010/0052297 | A1 | 3/2010 | Fukawatase et al. | |
| 2010/0154357 | A1 * | 6/2010 | Wochner | B65B 25/00 53/405 |
| 2012/0198793 | A1 * | 8/2012 | Vietz | B65B 1/32 53/450 |
| 2013/0042582 | A1 * | 2/2013 | Vietz | B65B 25/00 53/473 |
| 2013/0269295 | A1 * | 10/2013 | Mattes | B32B 9/045 53/428 |
| 2013/0309524 | A1 * | 11/2013 | Vietz | B02C 23/08 428/641 |
| 2014/0060422 | A1 * | 3/2014 | Martini | C30B 11/04 117/208 |
| 2014/0130455 | A1 * | 5/2014 | Lazarus | B65B 1/30 53/428 |
| 2014/0165503 | A1 * | 6/2014 | Vietz | B65B 1/28 53/432 |

FOREIGN PATENT DOCUMENTS

| | | | |
|---|---|---|---|
| CN | 202115892 | U | 1/2012 |
| DE | 3640520 | A1 | 6/1988 |
| DE | 10346881 | A1 | 5/2005 |
| DE | 102007027110 | A1 | 12/2008 |

(Continued)

OTHER PUBLICATIONS

PatBase abstract for DE 3640520.
PatBase abstract for DE 10346881.
PatBase abstract for CN202115892U (2012).

*Primary Examiner* — Mark A Laurenzi
*Assistant Examiner* — Andrew Schmid
(74) *Attorney, Agent, or Firm* — Caesar Rivise, PC

(57) ABSTRACT

The invention relates to a process for packaging polycrystalline silicon in the form of chunks, including the following steps: (a) providing polycrystalline silicon in a metering system; (b) filling polycrystalline silicon from the metering system, which removes fines by use of screening, into a plastic bag arranged below the metering system. The weight of the plastic bag with the polycrystalline silicon introduced is determined during the filling step and the filling step is ended after the attainment of a target weight. A fall height of the polycrystalline silicon from the metering system into the plastic bag is kept at less than 450 mm by use of at least one clamp apparatus over the entire filling step.

15 Claims, No Drawings

(56) References Cited

FOREIGN PATENT DOCUMENTS

| | | | |
|---|---|---|---|
| EP | 2487112 | A2 | 8/2012 |
| GB | 2197290 | A | 5/1988 |
| JP | 63148130 | A | 6/1988 |

* cited by examiner

PACKAGING OF POLYCRYSTALLINE SILICON

BACKGROUND OF THE INVENTION

The invention relates to the packaging of polycrystalline silicon.

Polycrystalline silicon, referred to hereinafter as polysilicon, serves, inter alia, as a starting material for the production of electronic components and solar cells.

It is obtained by thermal decomposition of a silicon-containing gas or of a silicon-containing gas mixture. This operation is referred to as deposition from the gas phase (CVD, chemical vapor deposition).

On a large scale, this operation is implemented in what are called Siemens reactors. In this case, the polysilicon is obtained in the form of rods. The polysilicon rods are generally comminuted by means of manual processes.

A number of machine processes are known, in which manually precrushed coarse polysilicon chunks are comminuted further using customary crushers. Mechanical crushing processes are described, for example, in U.S. Pat. No. 8,021,483 B2.

U.S. Pat. No. 8,074,905 discloses an apparatus comprising a device for feeding coarse polysilicon chunks into a crusher system, the crusher system and a sorting system for classification of the chunk polysilicon, wherein the crusher system is provided with a controller which allows variable adjustment of at least one crushing parameter in the crusher system and/or at least one sorting parameter in the sorting system.

For applications in the semiconductor industry and solar industry, chunk polysilicon with a minimum level of contamination is desirable. In order to accomplish this, various purification processes are also used.

US 2010/0001106 A1 describes a process for producing high-purity classified chunk polysilicon, in which a polysilicon from the Siemens process is comminuted and classified by means of a device comprising comminution tools and a screening device, and the chunk polysilicon thus obtained is cleaned by means of a cleaning bath, wherein all of the comminution tools and the screening device have a surface which comes into contact with the polysilicon made of a material which contaminates the chunk polysilicon only with those extraneous particles which are subsequently removed selectively by the cleaning bath.

Silicon dust adhering to the chunks is also regarded as contamination, since it reduces the yield in crystal pulling.

US 2010/0052297 A1 discloses a process for producing polycrystalline silicon, comprising crushing of polycrystalline silicon deposited on thin rods in a Siemens reactor into chunks, classifying the chunks into size classes from about 0.5 mm to greater than 45 mm and treating the chunks by means of compressed air or dry ice in order to remove silicon dust from the chunks, with no wet chemical purification.

However, the polycrystalline silicon has to be packaged after the comminution steps and any cleaning or dedusting performed before being transported to the customer.

Accordingly, it should be ensured that the packaging is effected with a minimum level of contamination.

Typically, chunk polysilicon for the electronics industry is packaged in 5 kg bags with a weight tolerance of +/−max. 50 g. For the solar industry, chunk polysilicon in bags with a weight of 10 kg and a weight tolerance of +/−max. 100 g is customary.

Tubular bag machines suitable in principle for packaging of chunk silicon are commercially available. A corresponding packaging machine is described, for example, in DE 36 40 520 A1.

Chunk polysilicon is, however, a sharp-edged, non-free-flowing material having a weight of the individual silicon chunks of up to 2500 g. Therefore, in the course of packaging, it should be ensured that the material does not penetrate the customary plastic bags in the course of filling, or in the worst case even completely destroys them.

In order to prevent this, the commercial packaging machines have to be modified in a suitable manner for the purpose of packaging polysilicon.

U.S. Pat. No. 7,013,620 B2 discloses an apparatus for inexpensive, fully automatic transportation, weighing, portioning, filling and packaging of a high-purity chunk polysilicon, comprising a conveyor channel for the chunk polysilicon, a weighing device for the chunk polysilicon, connected to a hopper, deflecting plates made from silicon, a filling device which forms a plastic bag from a highly pure plastic film, comprising a deionizer which prevents static charging and hence particle contamination of the plastic film, a welding device for the plastic bag filled with chunk polysilicon, a flowbox which is fitted above the conveyor channel, weighing device, filling device and welding device and which prevents contamination of the chunk polysilicon with particles, a conveyor belt with a magnetically inductive detector for the welded plastic bag filled with chunk polysilicon, wherein all components which come into contact with the chunk polysilicon are sheathed with silicon or clad with a highly wear-resistant plastic.

DE 103 46 881 A1 discloses a system for filling and sealing open plastic sacks, equipped with a filling machine comprising a rotor which can be driven so as to rotate about a vertical axis and is equipped with a plurality of filling devices on which the plastic sacks to be filled can be hung, and in which the filling devices are assigned welding units for production of the closure seams after the removal of the filled plastic sacks from the filling devices, and the system is also equipped with a linear discharge belt to transport the filled plastic sacks away from the filling machine, wherein the rotor of the filling machine can be driven at constant speed and is equipped with closure seam weld units assigned to the filling stubs, and the individual welding devices on the rotor of the filling machine are also assigned pivotable sack support devices which accept the plastic sacks to be removed from the filling devices immediately after the production of the closure seams by the welding devices and pass them onto a discharge belt which can be driven at the peripheral speed of the rotor and is arranged so as to be stationary and tangential thereto.

It has been found that, in the case of such apparatuses, jamming of the silicon chunks in the filling device often occurs. This is disadvantageous since it results in increased shutdown times for the machine.

Puncturing of the plastic bag also occurs, which likewise leads to a shutdown of the plant and to contamination of the silicon.

It has also been found that, during the packaging of chunks of a particular size class, for example chunks of 20 to 60 mm, unwanted smaller silicon particles or chunks also arise. The proportion of such unwanted particles for such chunk sizes is 17,000-23,000 ppmw.

Hereinafter, all chunks or particles of silicon having such a size that they can be removed by a mesh screen having 8 mm×8 mm square meshes are to be referred to as fines. Fines are undesirable to the customer, since they adversely affect the customer's operations. If the fines are removed by the customer, for example by screening, this means an increased level of cost and inconvenience.

As well as the automatic packaging of polycrystalline silicon, such as that according to U.S. Pat. No. 7,013,620 B2, manual packaging of the polycrystalline silicon in plastic bags is also an option. Manual packaging can distinctly reduce the fines fraction, for the abovementioned 20-60 mm chunk size from 17,000 ppmw down to 1400 ppmw.

However, manual packaging means a high level of complexity and increased personnel costs. Therefore, manual packaging is not an option for economic reasons. In addition, it would be desirable to reduce the fines fraction even further than is achievable by manual packaging.

It was therefore an object of the invention to automatically package polycrystalline silicon and to reduce the fines fraction which arises to an extremely low level. It was also an object of the invention to provide an apparatus suitable for this purpose.

DESCRIPTION OF THE INVENTION

The object of the invention is achieved by a process for packaging polycrystalline silicon, comprising the following steps:

providing polycrystalline silicon in a metering system;

filling polycrystalline silicon from the metering system, which removes fines by means of screening, into a plastic bag arranged below the metering system;

wherein the weight of the plastic bag with the polycrystalline silicon introduced is determined during the filling operation and the filling operation is ended after the attainment of a target weight;

wherein a fall height of the polycrystalline silicon from metering system into plastic bag is kept at less than 450 mm by means of at least one clamp apparatus over the entire filling operation.

Preferably, a fall height of the polycrystalline silicon from metering system into plastic bag is kept at less than 300 mm by means of at least one clamp apparatus over the entire filling operation.

The object is achieved by a clamp apparatus for an apparatus for packaging polycrystalline silicon in a plastic bag, which acts on the plastic bag such that it is compressed laterally by a clamp at a particular point, such that the cross-section thereof is reduced there, it being possible at any time to fully or partly release said clamp, such that the cross-section of the plastic bag increases again at this point.

The object is also achieved by a process for packaging polycrystalline silicon by filling into a plastic bag, using at least one clamp apparatus which acts on the plastic bag such that it is compressed laterally by a clamp at a particular point, such that the cross-section thereof is reduced there and polycrystalline silicon to be introduced in vertical direction can only get as far as this point in the plastic bag, it being possible to fully or partly release said clamp, such that the cross-section of the plastic bag increases again at this point and the polycrystalline silicon can move further downward in the plastic bag in vertical direction from this point.

It has been found that the new fines fraction which arises during the packaging is much smaller than in the case of conventional automatic packaging processes. For example, the fines fraction for chunk size 20-60 mm is 1400 ppmw or less.

The invention proceeds from silicon chunks of particular size classes which have been obtained by comminuting a rod deposited by means of the Siemens process, followed by sorting and classification.

The size class is defined as the longest distance between two points on the surface of a silicon chunk (=max. length):

Chunk size 0 [mm] 1 to 5
Chunk size 1 [mm] 4 to 15
Chunk size 2 [mm] 10 to 40

As well as the aforementioned size classes, classification and sorting of polycrystalline silicon into the following chunk sizes is likewise customary:

Chunk size 3 [mm] 20 to 60
Chunk size 4 [mm] 45 to 120
Chunk size 5 [mm] 90 to 200

In this context, at least 90% by weight of the chunk fraction in each case is within the size ranges mentioned.

The polysilicon chunks are transported via a conveyor channel and separated by means of at least one screen into coarse and fine chunks.

Unlike in the prior art, where the chunks were weighed by means of a metering balance and metered in up to a target weight, then conducted away via a removal channel and transported to a packaging unit and packaged, metering and packaging are effected in one step in the process according to the invention.

The metering system is configured such that fines, i.e. ultrafine particles and splinters of the polysilicon, are removed by means of screens before the filling operation. The screen may be a perforated plate, a bar screen, an optopneumatic sorter or another suitable apparatus. According to the chunk size, different screens can be used. For chunk sizes of 20 to 60 mm, preference is given to using screens having a screen width of 3 mm. In the case of chunk size of 45 to 120 mm, preference is given to using screens having a screen size of 9 mm.

Preferably, the surfaces of the screens used comprise at least a portion of a low-contamination material, for example a hard metal. Hard metals are understood to mean sintered carbide hard metals. As well as the conventional hard metals based on tungsten carbide, there are also hard metals which preferably include titanium carbide and titanium nitride as hard substances, in which case the binder phase comprises nickel, cobalt and molybdenum.

Preferably, at least the mechanically stressed, wear-sensitive surface regions of screens comprise hard metal or ceramic/carbides. Preferably, at least one screen is manufactured completely from hard metal. They may be provided with a partial coating or a coating over the full area. The coating used is preferably a material selected from the group consisting of titanium nitride, titanium carbide, aluminum titanium nitride and DLC (diamond-like carbon).

The chunk polysilicon is introduced into the plastic bag by means of a metering unit, preferably comprising a conveyor channel suitable for conveying a product stream of chunks, at least one screen suitable for separation of the product stream into coarse and fine chunks, a coarse metering channel for coarse chunks and a fine metering channel for fine chunks.

By separation of the product stream into coarse and fine pieces, more exact metering of the polysilicon is possible.

The size distribution of the polysilicon chunks in the starting material stream depends upon factors including the preceding comminution operations. The manner of division into coarse and fine chunks and the size of the coarse and fine chunks depend on the desired end product which is to be metered and packaged.

A typical chunk size distribution comprises chunks of sizes 1 to 200 mm.

For example, it is possible to conduct chunks below a particular size out of the metering unit by means of a screen, preferably by means of a bar screen, in conjunction with a removal channel. It is thus possible to accomplish metering and packaging only of chunks of a very particular size class.

The transport of the polysilicon to the conveyor channels again gives rise to unwanted product sizes. These are removed in the metering system by means of a screen.

The smaller chunks removed are classified again, metered and packaged in downstream operations, or sent to another use.

The metering of the polysilicon through the two metering channels can be automated.

It is also preferable to divide the silicon product stream between a plurality of integrated metering and packaging systems by means of a regulated swivel channel.

The polycrystalline silicon is filled from the metering system directly into the plastic bag, especially a PE bag, and weighed, preferably together with the packaging and a gripper system. The weighing system is based on a gross weight balance system.

The clamp apparatus serves to compress the bag during the filling operation. Thus, the polycrystalline silicon cannot fall through the entire bag length. The clamp device acts as a kind of fall arrestor which is pressed against the plastic bag, as a result of which the cross-section of the plastic bag is at first reduced and then released in a controlled manner.

It is thus possible to control the product flow, and filling of the silicon into the prefabricated bag is achieved, with only a small fines fraction being produced.

Fines are removed preferably by means of metering channels, at the end of which are mounted removal mechanisms, especially bar screens, which bring about the removal of the fines.

Preferably, the at least one clamp apparatus opens when a particular fill height and a particular weight of polycrystalline silicon have been attained in the bag.

The invention makes it possible to conduct the product stream to the bag without fines. This is accomplished with low-contamination screening in the metering system. A controlled arrangement of the metering channels (additional fine metering channels) makes it possible to bring the product stream very close to the opened bag. Thus, the material stream can be filled into the bag with the absolute minimum fall height. Preferably, the filling is effected via an inlet funnel. The inlet funnel preferably consists of a material having a low level of silicon contaminants.

By means of suitable sensors, the further reduction in fall height during the filling operation is recorded.

As soon as a fall height of nearly 0 mm has been attained, the product clamp can be released, such that the material drops down to the next clamp or the bottom of the bag.

Preferably, damping and storage elements are pivoted into the product stream. These are preferably manufactured from or coated with a low-contamination material. These elements accomplish a certain damping effect in relation to the product stream, absorb energy and are filled with polycrystalline silicon. After partial filling of the plastic bag, they are emptied and removed again from the product stream. This is desirable firstly for attainment of the cycle rate and secondly for further reduction in the fall height.

Preferably, the polysilicon chunks are recorded by a camera before the metering operation, in the course of which the specific weight of the chunks is determined and, in addition, the surface characteristics of the chunks are recognized.

This enables an even more exact and bag-protective packaging operation.

What is claimed is:

1. A process for packaging polycrystalline silicon in the form of chunks, comprising the following steps:

providing polycrystalline silicon in a metering system;

filling polycrystalline silicon from the metering system, which removes fines by way of screening, into a plastic bag arranged below the metering system;

wherein a weight of the plastic bag and the polycrystalline silicon is determined while the filling step occurs, and the filling step is ended after a target weight is reached;

wherein a fall height of the polycrystalline silicon from the metering system into the plastic bag is kept at less than 450 mm by use of at least one clamp apparatus pressing the plastic bag from outside the plastic bag during at least a portion of the filling step; and wherein the clamp apparatus is configured such that the plastic bag is compressed during the filling step, as a result of which a cross-sectional opening of the plastic bag through which the polycrystalline silicone flows is at first reduced and then released in a controlled manner.

2. The process as claimed in claim 1, wherein the metering system comprises a coarse metering channel for coarse chunks and a fine metering channel for fine chunks.

3. The process as claimed in claim 1, wherein several clamp apparatuses are provided over a length of the plastic bag, and are gradually released with increasing filling of the plastic bag.

4. The process as claimed in claim 1, wherein the polycrystalline silicon is filled into the plastic bag via an inlet funnel.

5. The process as claimed in claim 1, wherein damping and storage elements are pivoted into a stream of polysilicon between the metering system and the plastic bag, are filled with chunks and are emptied and removed again after a particular fill level of the plastic bag.

6. The process as claimed in claim 1, wherein a fall height of the polycrystalline silicon from the metering system into the plastic bag is kept at less than 300 mm by use of at least one clamp apparatus over the entire filling step.

7. A process according to claim 1, wherein said clamp apparatus is at a location that permits polycrystalline silicon to be held in said plastic bag above said location while preventing said polycrystalline silicon from moving from above said location to below said location, said process further comprising the step of stopping said pressing of the clamp apparatus so that said polycrystalline moves from above said location to below said location.

8. A process according to claim 1, wherein during said filling step and prior to reaching said target weight, said weight of said plastic bag and said polycrystalline film is measured while said weight is changing.

9. A process for packaging polycrystalline silicon by a step of filling polycrystalline into a plastic bag, using at least one clamp apparatus which presses on the plastic bag from outside the plastic bag such that the plastic bag is compressed laterally by a clamp at a particular point, such that the cross-section thereof is reduced there and polycrystalline silicon to be introduced in a vertical direction can only get as far as the particular point in the plastic bag, it being possible to fully or partly release said clamp, such that the cross-section of the plastic bag increases again at the particular point and the polycrystalline silicon can move further downward in the plastic bag in vertical direction from the particular point;

wherein a weight of the plastic bag and the polycrystalline silicon is determined while the filling step occurs, and the filling step is ended after a target weight is reached; and wherein the clamp apparatus is configured such that the plastic bag is compressed during the filling step, as a result of which a cross-sectional opening of the plastic bag through which the polycrystalline silicone flows is at first reduced and then released in a controlled manner.

10. The process as claimed in claim 9, wherein several clamp apparatuses are provided over a length of the plastic bag, and are gradually released with increasing filling of the plastic bag.

11. The process as claimed in claim 10, wherein the polycrystalline silicon is filled into the plastic bag via an inlet funnel.

12. The process as claimed in claim 11, wherein damping and storage elements are pivoted into a stream of polysilicon between the metering system and the plastic bag, are filled with chunks and are emptied and removed again after a particular fill level of the plastic bag.

13. The process as claimed in claim 9, wherein a fall height of the polycrystalline silicon from the metering system into the plastic bag is kept at less than 300 mm by use of at least one clamp apparatus over the entire filling step.

14. A process according to claim 9, wherein said clamp is at a location that permits polycrystalline silicon to be held in said plastic bag above said location while preventing said polycrystalline silicon from moving from above said location to below said location, said process further comprising the step of stopping said pressing of the clamp apparatus so that said polycrystalline moves from above said location to below said location.

15. A process according to claim 9, wherein during said filling step and prior to reaching said target weight, said weight of said plastic bag and said polycrystalline film is measured while said weight is changing.

* * * * *